US010815707B2

(12) United States Patent
Piltingsrud

(10) Patent No.: US 10,815,707 B2
(45) Date of Patent: Oct. 27, 2020

(54) WINDOW OPENING LIMIT DEVICES AND METHOD OF USE

(71) Applicant: Amesbury Group, Inc., Amesbury, MA (US)

(72) Inventor: Steve Piltingsrud, Sioux Falls, SD (US)

(73) Assignee: Amesbury Group, Inc., Amesbury, MA (US)

( * ) Notice: Subject to any disclaimer, the term of this patent is extended or adjusted under 35 U.S.C. 154(b) by 206 days.

(21) Appl. No.: 16/150,494

(22) Filed: Oct. 3, 2018

(65) Prior Publication Data

US 2019/0032378 A1 Jan. 31, 2019

Related U.S. Application Data

(63) Continuation of application No. 14/591,151, filed on Jan. 7, 2015, now Pat. No. 10,119,311, which is a (Continued)

(51) Int. Cl.

| | |
|---|---|
| ***E05C 17/02*** | (2006.01) |
| ***E05C 17/46*** | (2006.01) |
| ***E05C 17/60*** | (2006.01) |
| ***E06B 7/00*** | (2006.01) |
| *E06B 3/44* | (2006.01) |

(52) U.S. Cl.

CPC ..... *E05C 17/02* (2013.01); *E05C 17/46* (2013.01); *E05C 17/60* (2013.01); *E06B 7/00* (2013.01); *E06B 3/44* (2013.01); *Y10S 292/20* (2013.01); *Y10S 292/47* (2013.01); (Continued)

(58) Field of Classification Search

CPC ..... E05C 17/44; E05C 17/443; E05C 17/446; E05C 17/46; E05C 17/48; E05C 17/50; E05C 17/52; E05C 17/02; E05C 17/60; E05C 17/62; E05C 1/08; E06B 7/00; (Continued)

(56) References Cited

U.S. PATENT DOCUMENTS 389,217 A 9/1888 Glenn
417,868 A * 12/1889 Janes ..... E05B 65/0852 292/67

(Continued)

OTHER PUBLICATIONS

Standard F2090-10, entitled "Standard Specification for Window Fall Prevention Devices With Emergency Escape (Egress) Release Mechanisms," printed Sep. 23, 2013, copyright ASTM International, West Conshohocken, PA, 12 pgs.

*Primary Examiner* — Catherine A Kelly

(57) ABSTRACT

A method of operating a window having a sash and a window opening limit device includes moving the sash from a closed position to a limited position. When in the limited position, the window opening limit device is in a projected position, and the sash is engaged with the window opening limit device. Moving the window opening limit device to a retracted position disengages the sash and the window opening limit device. The sash may then be moved from the limited position to an open range. When the sash is returned to the closed position, the window opening limit device automatically returns to the projected position, and the sash is disengaged with the window opening limit device.

19 Claims, 24 Drawing Sheets

Related U.S. Application Data continuation of application No. 13/278,966, filed on Oct. 21, 2011, now Pat. No. 8,950,119.

(60) Provisional application No. 61/412,578, filed on Nov. 11, 2010, provisional application No. 61/405,923, filed on Oct. 22, 2010.

(52) U.S. Cl.
CPC ..... *Y10T 292/0886* (2015.04); *Y10T 292/097* (2015.04); *Y10T 292/0997* (2015.04); *Y10T 292/65* (2015.04)

(58) Field of Classification Search
CPC ..... E06B 7/28; E06B 65/0829; E05F 5/00; E05F 5/003; E05D 13/04
See application file for complete search history.

(56) References Cited

U.S. PATENT DOCUMENTS 534,185 A 2/1895 Winchester
580,330 A * 4/1897 Russell ..... E05C 17/50 292/121
976,777 A * 11/1910 Brown ..... E05B 65/0852 292/63
1,279,353 A * 9/1918 Kelly et al. ..... E05B 65/0852 292/219
1,485,382 A 3/1924 Foley
2,202,561 A * 5/1940 Lahiere ..... E05C 17/443 292/238
2,503,606 A * 4/1950 Anderson ..... E05D 13/04 292/237
2,527,032 A * 10/1950 Riley ..... E05C 17/443 49/420
2,752,185 A * 6/1956 Coppola ..... E05C 17/443 49/415
2,955,860 A * 10/1960 Jacques ..... E05C 17/443 292/63
3,151,901 A * 10/1964 Aldgren ..... E05D 13/04 292/124
4,110,867 A * 9/1978 Gwozdz ..... E05B 65/06 16/82
4,423,897 A * 1/1984 Williams ..... E05B 65/0864 292/288
4,824,154 A * 4/1989 Simpson ..... E05C 5/00 292/338
4,923,230 A 5/1990 Simpson
5,174,617 A * 12/1992 Huber ..... E05B 17/2038 292/106
5,248,174 A * 9/1993 Matz ..... E05B 65/0852 292/338
5,475,945 A * 12/1995 Baker ..... E05C 17/443 292/238
5,536,052 A * 7/1996 Maier ..... E05B 65/08 292/338
5,553,903 A * 9/1996 Prete ..... E05B 9/08 292/138
5,575,116 A * 11/1996 Carlson ..... E05B 65/0852 49/417
5,806,900 A * 9/1998 Bratcher ..... E05B 65/0864 292/137
6,364,375 B1 4/2002 Szapucki et al.
6,484,444 B1 11/2002 Polowinczak
6,484,445 B2 * 11/2002 Chang ..... E05B 65/0823 292/289
6,565,133 B1 5/2003 Timothy
6,572,158 B2 * 6/2003 Szapucki ..... E05B 65/0852 292/221
6,854,214 B2 * 2/2005 Polowinczak ..... E05B 65/0864 49/449
6,871,451 B2 3/2005 Harger et al.
7,431,356 B2 * 10/2008 Liang ..... E05B 65/0852 292/219
7,494,164 B1 * 2/2009 Garries ..... E05B 65/0835 292/332
7,530,611 B2 5/2009 Liang et al.
7,559,588 B2 * 7/2009 Liang ..... E05D 13/00 16/82
7,588,271 B1 * 9/2009 Lawrence ..... E05B 65/0852 292/240
7,600,796 B2 * 10/2009 Liang ..... E05C 17/50 292/207
7,637,544 B2 * 12/2009 Liang ..... E05C 17/50 292/338
8,083,273 B2 12/2011 Yuan
8,235,430 B2 * 8/2012 Liang ..... E05B 15/04 292/338
8,360,484 B2 1/2013 Liang et al.
8,776,441 B1 * 7/2014 Lawrence ..... E05B 65/0852 292/DIG. 47
8,776,442 B1 * 7/2014 Lawrence ..... E05B 9/08 292/DIG. 47
8,789,862 B2 * 7/2014 Liang ..... E05B 63/0056 292/300
8,806,809 B1 * 8/2014 Lawrence ..... E05D 13/06 292/338
8,881,461 B2 * 11/2014 Derham ..... E05C 3/12 49/449
9,404,288 B2 * 8/2016 Curtis ..... E06B 3/4415
9,840,860 B2 * 12/2017 Liang ..... E05B 63/0056
2003/0167694 A1 9/2003 Liang
2005/0011131 A1 1/2005 Liang et al.
2005/0146143 A1 * 7/2005 Lutfallah ..... E05C 17/48 292/153
2005/0229511 A1 10/2005 Balbo Di Vinadio
2007/0222233 A1 9/2007 Liang et al.
2007/0222234 A1 * 9/2007 Liang ..... E05C 17/50 292/338
2007/0246953 A1 10/2007 Liang et al.
2008/0079268 A1 4/2008 Liang et al.
2008/0127568 A1 6/2008 Liang et al.
2008/0150300 A1 6/2008 Harger et al.
2009/0019779 A1 1/2009 Nakanishi et al.
2009/0096220 A1 4/2009 Lutfallah
2009/0206616 A1 * 8/2009 Liang ..... E05C 17/60 292/338
2010/0071269 A1 3/2010 Isley
2010/0281780 A1 11/2010 Liang et al.
2010/0300000 A1 12/2010 Liang et al.
2011/0192089 A1 8/2011 Barton et al.
2012/0124911 A1 * 5/2012 Hagemeyer ..... E05C 17/50 49/394
2012/0144752 A1 6/2012 Piltinsgrud
2012/0167475 A1 * 7/2012 Sopkowiak ..... E05B 65/0835 49/449
2015/0113880 A1 4/2015 Piltinsgrud
2018/0119463 A1 * 5/2018 Liang ..... E05B 3/0056

* cited by examiner

WINDOW OPENING LIMIT DEVICES AND METHOD OF USE

CROSS-REFERENCE TO RELATED APPLICATIONS

This application is a continuation application of U.S. patent application Ser. No. 14/591,151, filed Jan. 7, 2015, now U.S. Pat. No. 10,119,311, which is a continuation application of U.S. patent application Ser. No. 13/278,966, filed Oct. 21, 2011, now U.S. Pat. No. 8,950,119; which claims priority to and the benefit of U.S. Provisional Patent Application Ser. No. 61/405,923, filed Oct. 22, 2010, entitled "Window Opening Limit Device and Method of Use"; and U.S. Provisional Patent Application Ser. No. 61/412,578, filed Nov. 11, 2010, entitled "Frame-mounted Window Opening Limit Device and Method of Use"; the disclosures of which are hereby incorporated by reference herein in their entireties.

INTRODUCTION

The distance a window may open may be limited by the use of a window opening limit device (WOLD). These WOLDs typically are installed in one window sash of a double hung window (or other sliding window) and project from the window sash when activated. As the opposite window sash is opened, the WOLD limits the distance of the opening, either for safety (to prevent inadvertent egress of a child) and/or security (to prevent an intruder from gaining access). Once a WOLD is deactivated, the window may be opened completely; however, the WOLD remains deactivated until reset by an action on the part of a user, even if the window is subsequently closed.

Recently, changes in building codes have required enhancements for WOLDs. For example, ASTM International has released Standard F2090-10, entitled "Standard Specification for Window Fall Prevention Devices With Emergency Escape (Egress) Release Mechanisms," the disclosure of which is hereby incorporated by reference herein in its entirety. Among other requirements, this standard requires that a WOLD automatically resets when a window is moved to a closed position, withstand forces to prevent inadvertent egress or active intrusion, and allow a disabled user to disengage a WOLD using a single hand.

SUMMARY

In one aspect, the technology relates to a window opening limit device having a slider, a button movably engaged with the slider, wherein the button is positionable in a retracted position and a projected position, and a projecting spring for biasing the button toward the projected position. In an embodiment, the window opening limit device includes a bezel, wherein the slider is slidably engaged with the bezel, and wherein the slider is slidable between a first position and a second position. In another embodiment, the window opening limit device includes a return spring for biasing the slider toward the first position. In yet another embodiment, the button is pivotally engaged with the slider. In still another embodiment, the slider includes a front surface, wherein when in the retracted position, the button is positioned substantially behind a plane defined by the front surface, and wherein when in the projected position, at least a portion of the button projects beyond the plane defined by the front surface.

In another aspect, the technology relates to a window including a first sash; and a window opening limit device having a slider positionable in a first position and a second position; a button movably engaged with the slider, wherein the button is positionable in a retracted position and a projected position; and a projecting spring for biasing the button toward the projected position. In an embodiment, the first sash is slidably positionable in a closed range, a contacted range, a limited position, and an open range. In another embodiment, the first sash is in the closed range, the button is in the projected position and the first sash is not engaged with the button. In yet another embodiment, the first sash is in the contacted range, the button is in the projected position and the first sash is engaged with the button. In still another embodiment, when the first sash is in the limited position, the button is in the projected position and the first sash is engaged with the button.

In another embodiment of the above aspect, when the first sash is in the open range, the button is in the refracted position and the first sash is not engaged with the button. In certain embodiments, the slider is in the first position when the first sash is in each of the closed range and the open range, and the slider is in the second position when the first sash is in the limited position. In another embodiment, the window opening limit device further includes a bezel wherein the slider is slidably engaged with the bezel. In yet another embodiment, the window further includes a frame, wherein the window opening limit device is at least partially inserted within the frame, and wherein the first sash is slidably engaged with the frame. In yet another embodiment, the window further includes a second sash, wherein the window opening limit device is at least partially inserted within the second sash, and wherein the first sash is slidable relative to the second sash.

In another aspect, the technology relates to a method of operating a window having a sash and a window opening limit device, the method including: moving the sash from a closed position to a limited position, wherein when in the limited position, the window opening limit device is in a projected position, and the sash is engaged with the window opening limit device; moving the window opening limit device to a retracted position so as to disengage the sash and the window opening limit device; moving the sash from the limited position to an open range; and moving the sash from the open range to the closed position, such that when the sash is in the closed position, the window opening limit device automatically returns to the projected position, and the sash is disengaged with the window opening limit device. In an embodiment, when in the limited position, engagement of the sash and the window opening limit device substantially prevents movement of the sash from the limited position to the open range.

In an embodiment of the above aspect, the technology relates to a window opening limit device including: a housing having a front face, a rear face, and a mounting flange; a button slidably and pivotally engaged with the housing, the button including a locking end; and a spring for biasing the locking end toward a projected position, wherein when in the projected position, the locking end projects beyond the front face. In an embodiment, the button includes a release end, and when the locking end is in the projected position, the release end projects beyond the rear face. In another embodiment, the locking end is positionable in a retracted position, and when in the retracted position, the locking end and the release end are located substantially within the housing. In yet another embodiment, the button is positionable in a first position and a second position, wherein the spring biases the button toward the first position. In still another embodiment, the spring is connected to the housing and the button.

In another aspect, the technology relates to a window including: a window frame; a window sash slidably engaged with the window frame; and a window opening limit device secured to the window frame, the window opening limit device including: a housing having a front face, a rear face, and a mounting flange; a button slidably and pivotally engaged with the housing, the button having a locking end; and a spring for biasing the locking end toward a projected position, wherein when in the projected position, the locking end projects beyond the front face. In an embodiment, the sash is slidably positionable in a closed range, a contacted range, a limited position, and an open range. In another embodiment, when the sash is in the closed range, the locking end is in the projected position and the sash is not engaged with the locking end. In yet another embodiment, when the sash is in the contacted range, the locking end is in the projected position and the sash is engaged with the locking end. In still another embodiment, when the sash is in the limited position, the locking end is in the projected position and the sash is engaged with the locking end.

In another embodiment of the above aspect, when the sash is in the open range, the locking end is in the retracted position and the sash is not engaged with the locking end. In another embodiment, the button is positionable in a first position and a second position, the spring biases the button toward the first position; and the button is in the first position when the sash is in each of the closed range and the open range; and the button is in the second position when the sash is in the limited position. In yet another embodiment, the button further includes a release end, and when the locking end is in the projected position, the release end projects beyond the rear face. In still another embodiment, the locking end is positionable in a retracted position, and when in the retracted position, the locking end and the release end are located substantially within the housing.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1A:
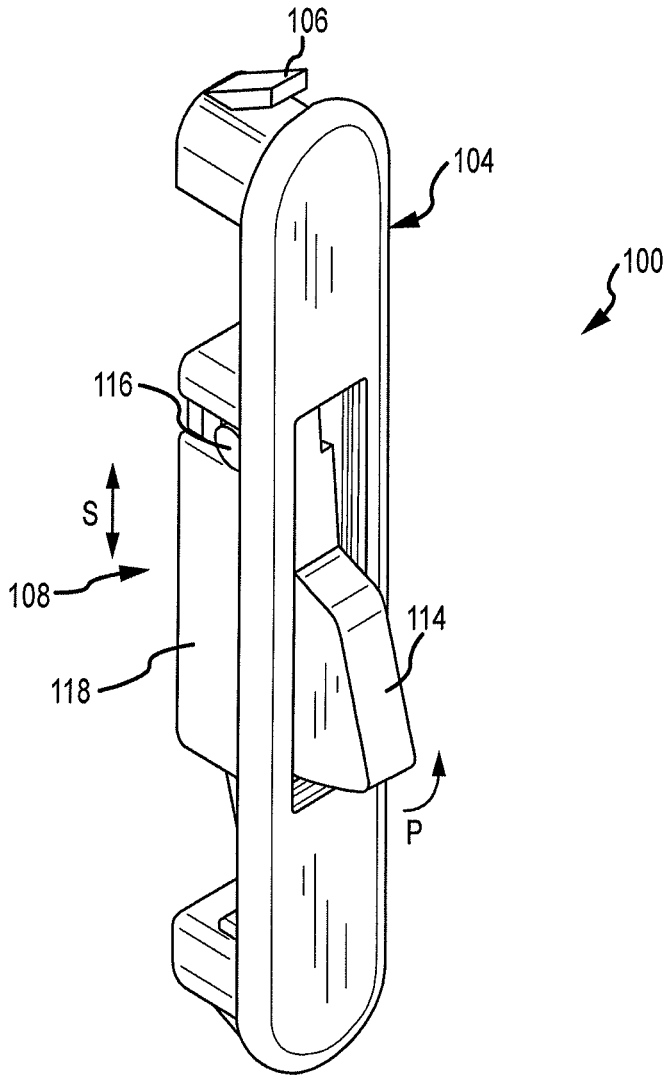
FIG. 1A is a front perspective view of a window opening limit device.
Figure 1B:
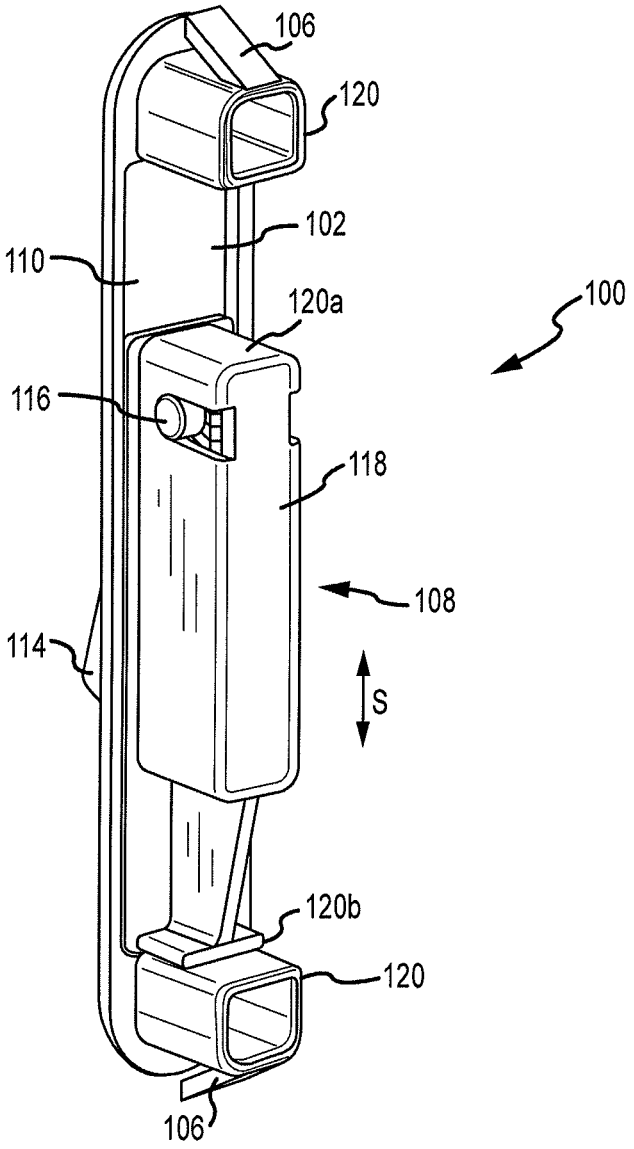
FIG. 1B is a rear perspective view of the window opening limit device of FIG. 1A.
Figure 1C:
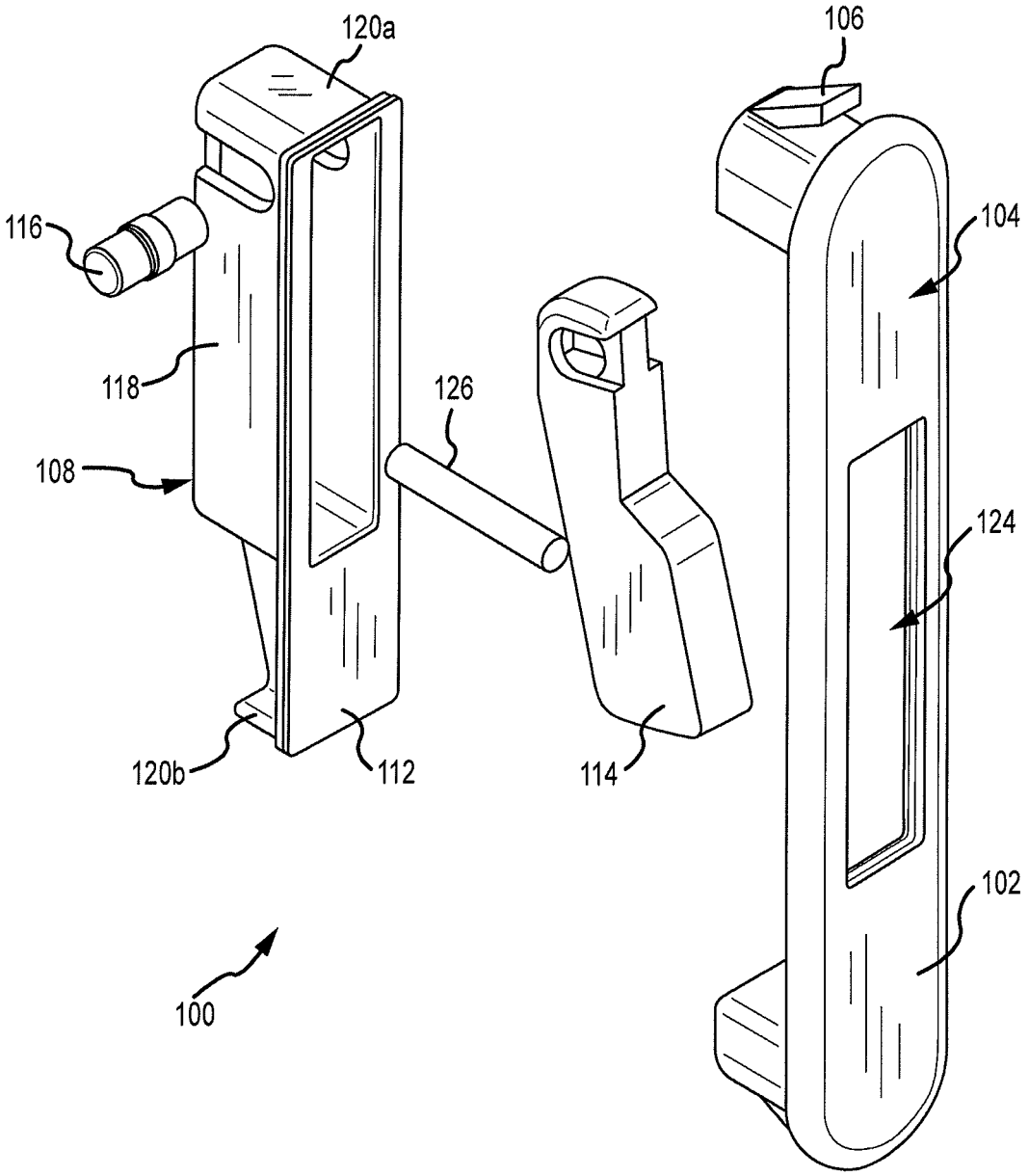
FIG. 1C is an exploded front perspective view of the window opening limit device of FIG. 1A.

FIGS. 1A-1C depicts one embodiment of a window opening limit device (WOLD) 100. The WOLD 100 is sized to fit within an opening or cut-out in the face of a window sash or window frame. A bezel 102 includes a bezel face 104, generally dimensioned to cover the outer edges of the opening into which the WOLD 100 is inserted. The bezel 102 includes one or more integral locking elements 106 that hold the WOLD 100 in place in the window sash. Alternatively, mounting screws or nails through the bezel face 104, chemical adhesives, or other attachment means may be utilized. Deflectable locking elements 106 such as those depicted allow a defective or damaged WOLD 100 to be easily replaced.

A slider 108 is located behind the bezel 106. The rear of the bezel 106 may include a bezel recess 110 sized to accommodate the outer dimensions of a face 112 of the slider 108. The bezel recess 110 forms a track in which the slider 108 may slidably engage with the bezel 102, thereby limiting twisting and potential disengagement. The sliding movement S of the slider 108 is described below. The slider 108 may be a complete or partial enclosure for a button 114 or locking tab that is connected to the slider 108 with an axle 116 or hinge for pivotal movement of the button 114 relative to the slider 108. Alternatively, a snap fit connection may be utilized in place of the axle 116. Alternative embodiments of the slider include a cage-like housing or a bracket configured to suspend the button via the axle. An enclosed housing 118 may be desirable, however, to limit infiltration of outside air through the WOLD 100 into a building interior. The slider 100 includes stops 120 that may be surfaces 120*a* of the slider 108 itself or extension elements 120*b* that project from the slider 108. Both configurations of stops 120 are depicted in FIG. 1B. During use, these stops 120 contact one or more projections 122 that may extend from the bezel 102, thereby preventing further movement of the slider 108. In the depicted embodiment, the projections 122 are integral with both the bezel 102 and the locking elements 106. In alternative embodiments, the stops 120 may directly contact a portion of the window opening, a tab that remains as part of the routing process, or a discrete projection that extends from the rear of the bezel 102.

A coiled projecting spring or other biasing element 126, such as a leaf spring, interacts with the slider 108 and the button 114 to pivotally bias P the button 114 towards a projected position, where the button 114 projects through an opening 124 defined by the bezel 102. In other embodiments of the WOLD, a return spring may be utilized between the stop nearest the hinge and the associated projection to force the slider into the position depicted in the figures. Alternatively or additionally, a spring may be used proximate the opposite projection to draw the slider into the depicted position.

Figure 2A:
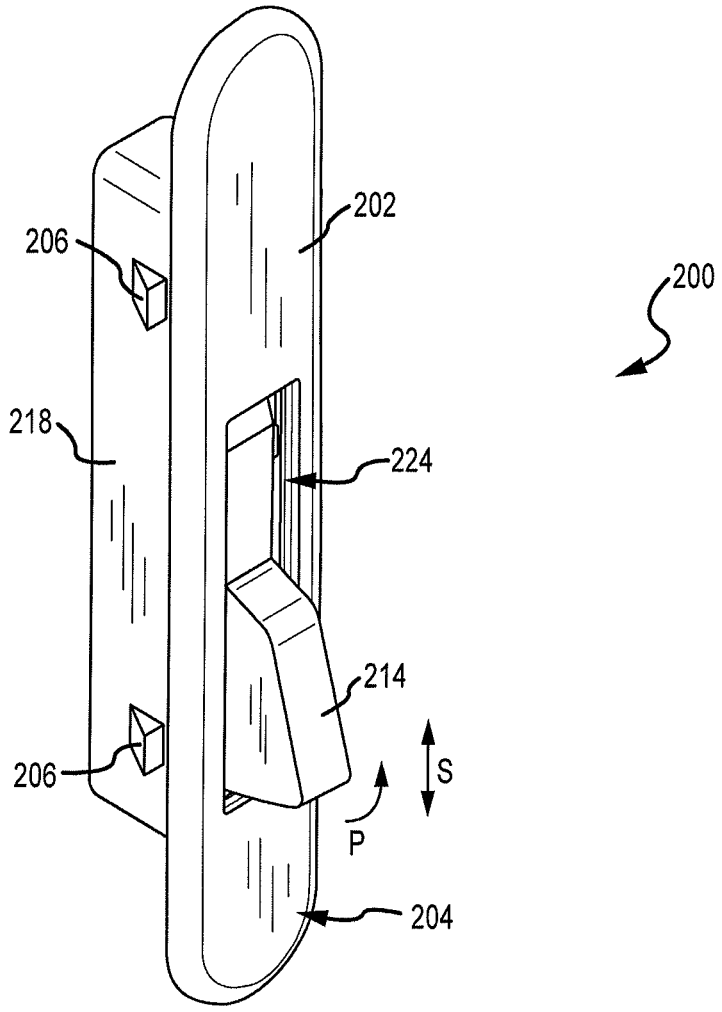
FIG. 2A is a front perspective view of another window opening limit device.
Figure 2B:
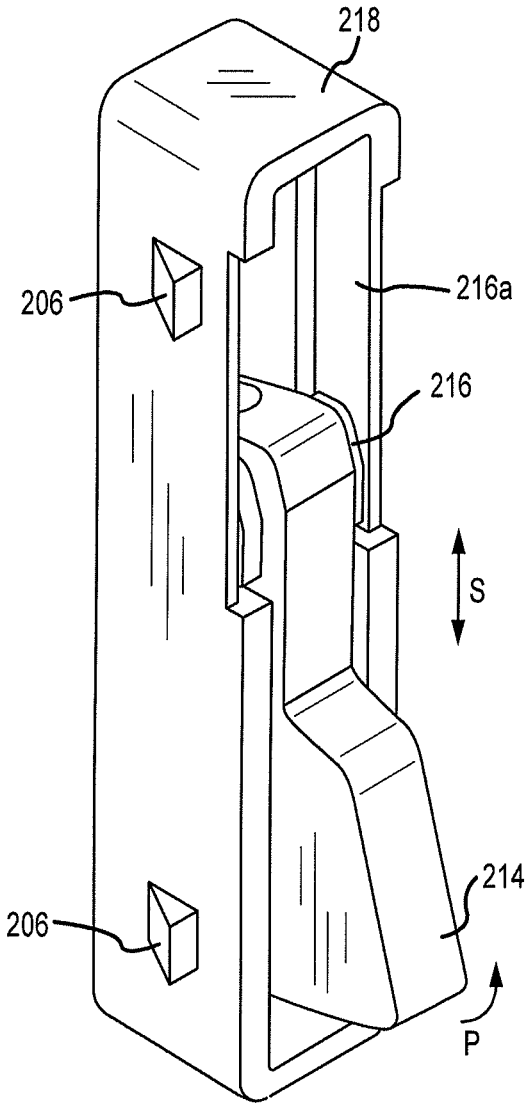
FIG. 2B is a front perspective view of components of the window opening limit device of FIG. 2A.
Figure 2C:
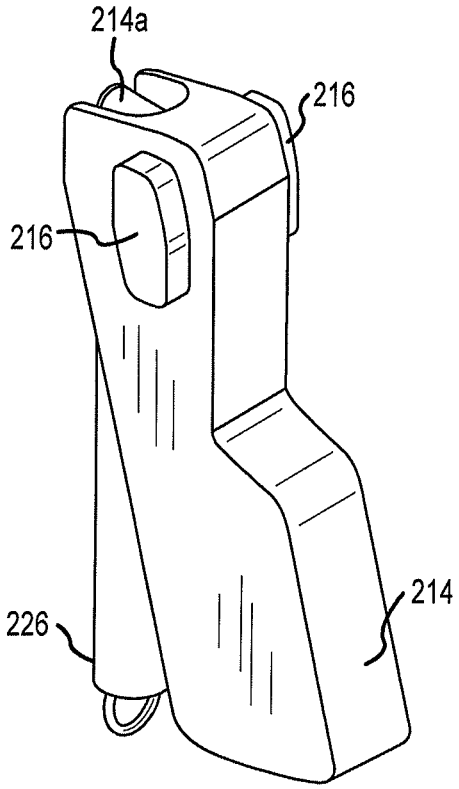
FIG. 2C is a front perspective view of components of the window opening limit device of FIG. 2A.

FIGS. 2A-2C depicts another embodiment of a WOLD 200. This embodiment also includes a bezel 202 having a bezel face 204 and an opening 224 therein. In lieu of the slider depicted above, however, the WOLD 200 depicted in FIGS. 2A-2C utilizes a housing 218 secured to the rear of the bezel 202. One or more locking elements 206 may be located on the housing 218, the bezel 202, or both to secure the WOLD 200 within the window sash. As depicted in FIGS. 2B and 2C, a button 214 is configured to slide S relative to both the bezel 202 (as in the previous embodiment) and the housing 218 in which it is contained (unlike the previous embodiment, where the button 114 moved with the slider housing 118). To this end, the button 214 includes two integral projections 216 that are configured to slide in a sliding recess 216 or slot formed in the walls of the housing 218. Alternatively, a separate axle, as described above, may be utilized. In this embodiment, a spring 226 connects the housing 218 with a post 214*a* proximate the projections 216. This spring 226 performs two functions. First, it forces the button 214 to pivot on the projections 216, such that the button 214 is biased to project pivotally P through the opening 224. Second, it biases the button 214 toward the bottom position depicted in the figures, as the button 214 moves within the housing 218 during opening of a window sash.

Figure 3:
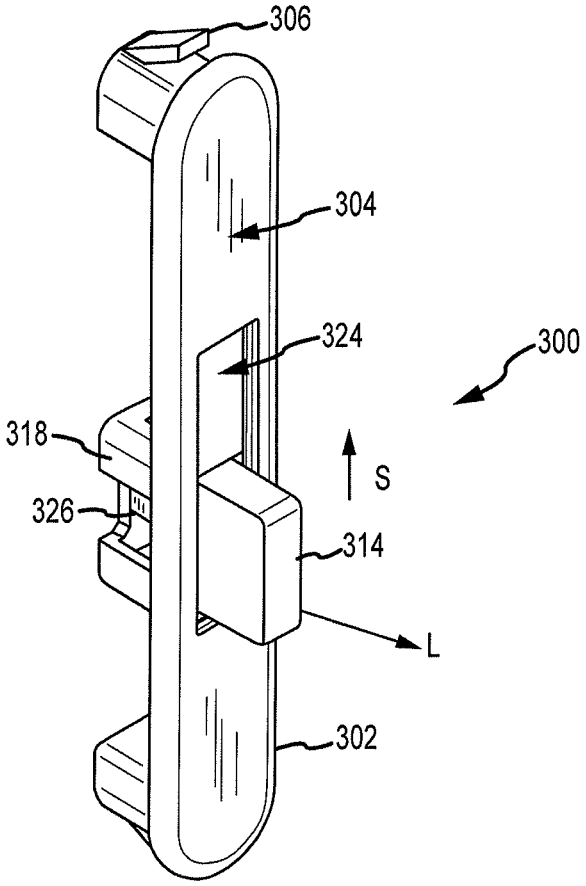
FIG. 3 is a front perspective view of another window opening limit device.

FIG. 3 depicts another embodiment of a WOLD 300. In this embodiment, a button 314 or locking tab is configured to project linearly L (as opposed to pivotally, as in the first two WOLD embodiments) out of the slider housing 318, through an opening 324 on the bezel face 304. A leaf or coil spring or other biasing element 326 engaged between the slider housing 318 and the button 314 biases the button 314 forward through the opening 324. One or more locking elements 306 project from a rear of the bezel 302. In general, the embodiment of the WOLD 300 depicted in FIG. 3 operates similar to the embodiment depicted in FIGS. 1A-1C.

Figure 4B:
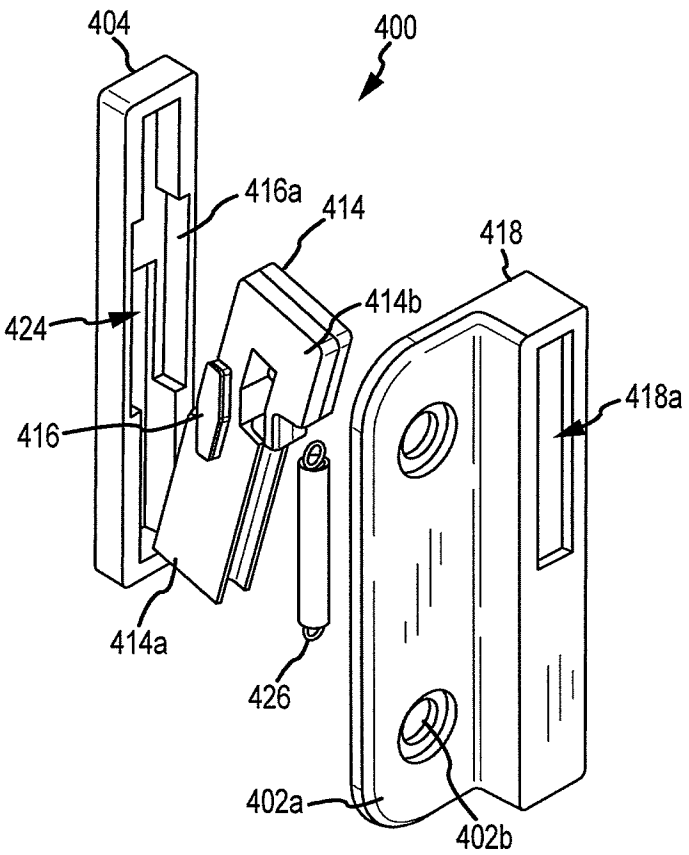
FIG. 4B is an exploded rear perspective view of the window opening limit device of FIG. 4A.
Figure 4A:
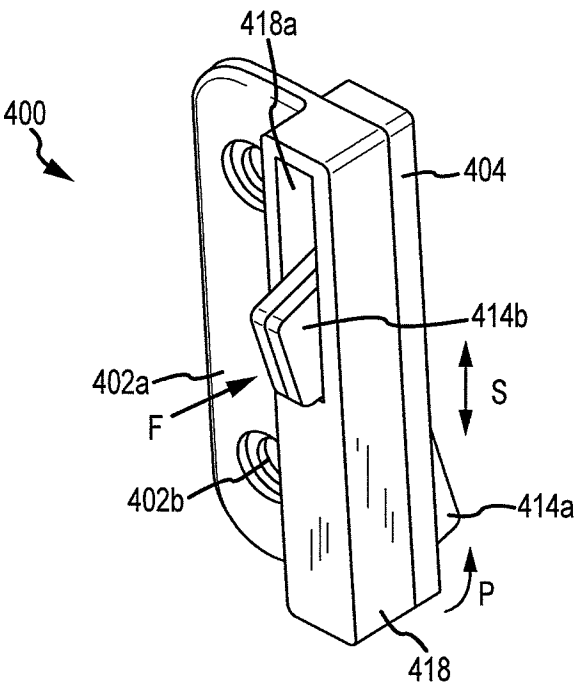
FIG. 4A is a rear perspective view of another window opening limit device.

FIGS. 4A and 4B depict yet another embodiment of a WOLD 400. This embodiment includes a housing 418, a mounting flange 402*a*, and a face element 404. The flange 402*a* defines one or more openings 402*b* that may be used to secure the WOLD 400 to a window frame with screws or other fasteners. Alternatively, chemical adhesives may be utilized. As depicted in FIGS. 4A and 4B, a button 414 is configured to move both slidably S and pivotally P within the housing 418 in which it is located. To this end, the button 414 includes two integral projections 416 that are configured to slide S in a sliding recess 416*a* or slot formed in the walls of the housing 418. Alternatively, a separate axle, as described above, may be utilized. In this embodiment, a spring 426 connects the housing 418 to the button 414. This spring 426 performs two functions. First, it forces the button 414 to pivot P on the projections, such that a locking end 414*a* of the button 414 is biased to project through a face opening 424. Second, it biases the button 414 toward the bottom position depicted in FIG. 4A, as the button 414 moves within the housing 418 during opening of a window sash. When the projections 416 are proximate a lower end of the sliding recess 416*a*, the button 414 is in a first position; when the projections 416 are proximate an upper end of the sliding recess 416*a*, the button 414 is in a second position. The button 414 in FIGS. 4A and 4B also includes a release end 414*b*. When the locking end 414*a* is in the projected position, the release end 414*b* is also in a projected position, projecting through an access opening 418*a* on the housing 418. The application of a force F to the release end 414*b* pivots the button 414, thus moving both the release end 414*b* and the locking end 414*a* into retracted positions substantially within the housing 418.

FIGS. 5A-5D depict a window 500 including a WOLD 100 as described above with regard to FIGS. 1A-1C or FIGS. 2A-2C. For clarity, in the remaining paragraphs, the embodiment depicted in FIGS. 1A-1C will be described, unless otherwise noted. A person of skill in the art will understand the differences in operation and functionality of the WOLD 200 depicted in FIGS. 2A-2C. Additionally, in so far as the WOLD 300 depicted in FIG. 3 also uses a button/slider/bezel combination, the differences in functionality and operation with that embodiment will also be understood by a person of skill in the art.

In the following paragraphs, the operation of the WOLD will be described using the terms upper sash and lower sash, as typical in a double-hung window installation. The use of these terms is for illustrative purposes only. A person of skill in the art will understand, based on the description provided herein, the operation of a WOLD installed in a window frame (e.g., in the jamb, perpendicular to the plane defined by the sash) or in a sash of a single-hung window. Additionally, the various embodiments of the WOLDs described herein may be used in conjunction with window sashes that slide horizontally, instead of vertically, as depicted. If installed in horizontally-oriented sashes, however, a return spring such as that described with regard to FIGS. 1A-1C should be used to bias the slider into its starting position. The WOLD depicted in FIGS. 2A-2C may be used in horizontal window applications.

Figure 5A:
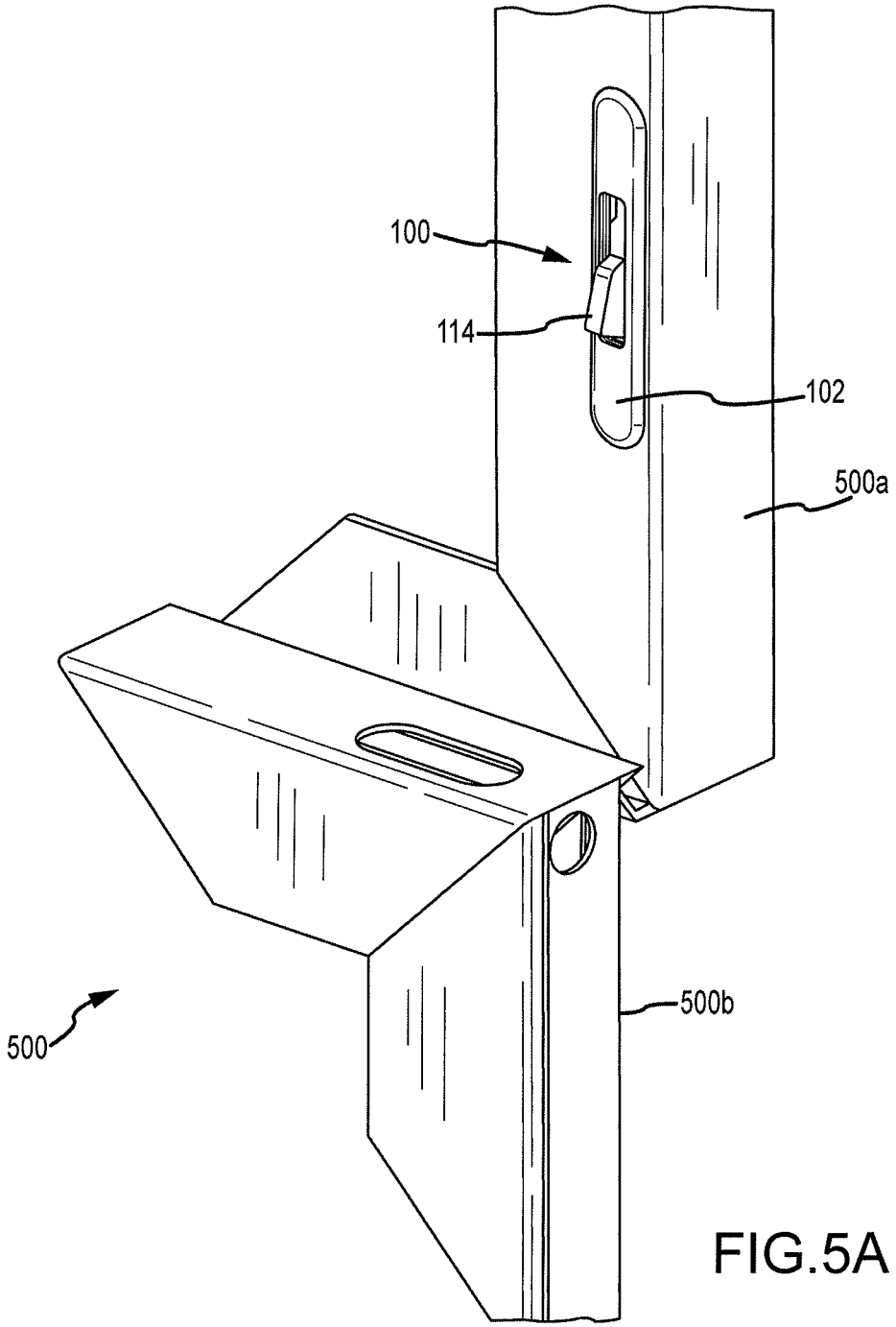
FIG. 5A is a partial front perspective view of a window having a window sash in a closed range.

In the depicted embodiment, the WOLD 100 is installed within an upper window sash 500*a* of a double-hung window 500. FIG. 5A depicts a lower window sash 500*b* in a closed range. In this case, the closed range includes any position of the lower window sash 500*b* from the completely closed position to a position just prior to the contacted position. While the lower sash is in the closed range, the button 114 extends through the opening on the bezel 102 and the lower window sash 500*b* is not in contact with the button 114. The various ranges are described in more detail with regard to FIGS. 8A and 8B, below.

Figure 5B:
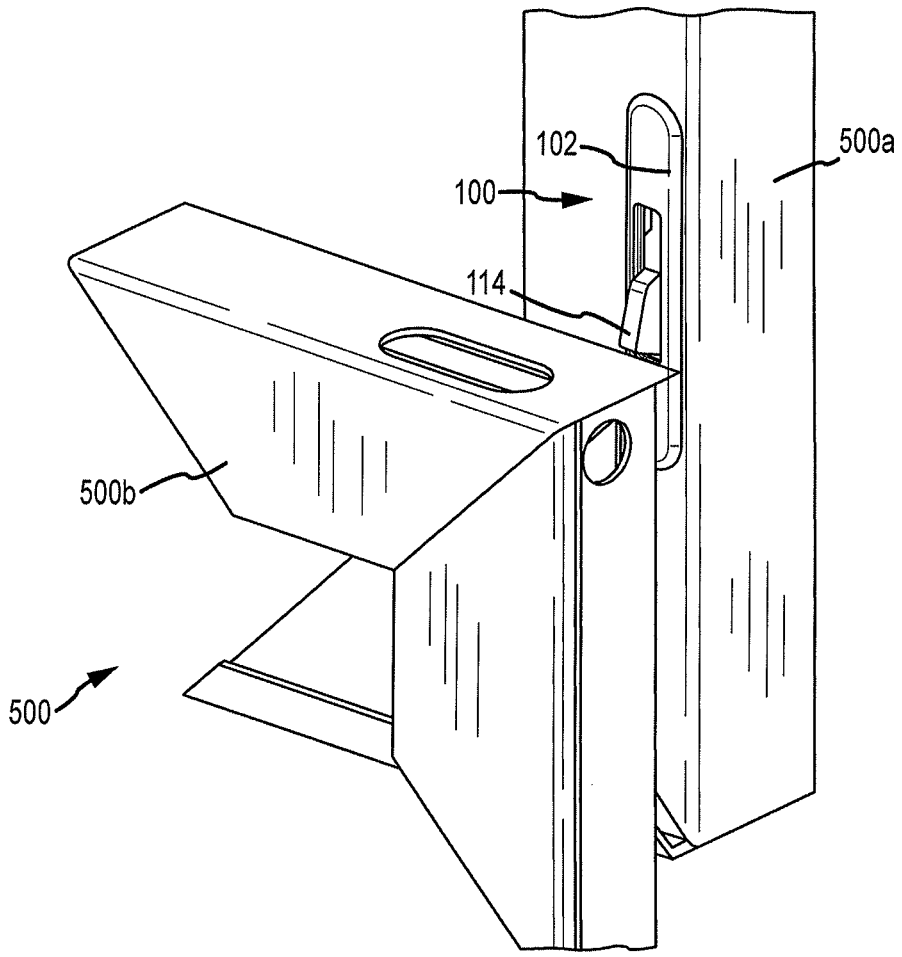
FIG. 5B is a partial front perspective view of the window of FIG. 5A having the window sash in a contacted position.

FIG. 5B depicts the lower sash 500*b* in a contacted range. In this case, the contacted range includes any position of the lower sash 500*b* from the contacted position to just prior to the sash 500*b* reaching the limited position. At the beginning of the contacted range, in the contacted position, the lower sash 500*b* first contacts the button 114 as the lower sash 500*b* is being raised. This contact may occur as the lower sash 500*b* is lifted a predefined distance from the closed position, as dictated largely by the position of the WOLD 100. This distance to the contacted position may be about 3½ inches or some other distance, as desired or as dictated by building or safety codes. The lower sash 500*b* remains in the contacted range as the lower sash 500*b* moves upward, in some cases about another ½ inch. The total distance the window sash 500*b* travels in the contacted range may be dictated by code, and in the depicted embodiment, is controlled in part by the distance the slider may move before the upper stop contacts the upper projection (i.e., the total length of the WOLD 100). This movement is further described below in FIGS. 6A-6D.

Figure 5C:
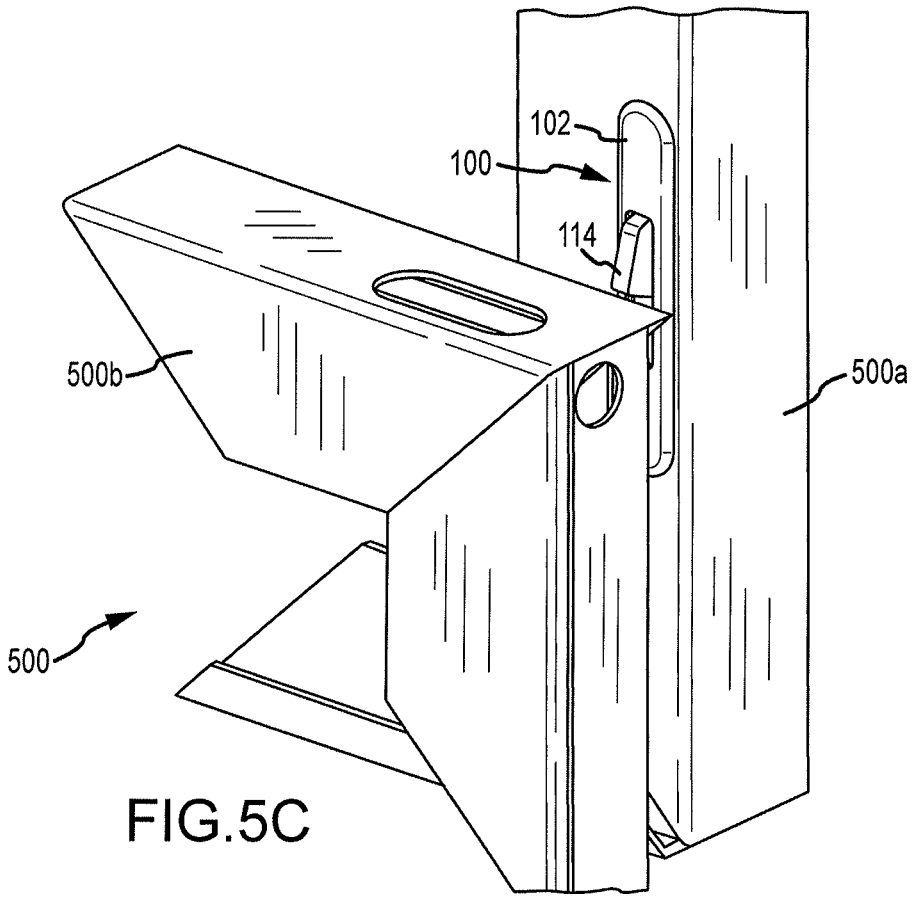
FIG. 5C is a partial front perspective view of the window of FIG. 5A having the window sash in a limited position.

FIG. 5C depicts the lower sash 500*b* in a limited position. In this case, the limited position is reached when the slider contacts the upper projection, and is described in more detail below. In the limited position, the interaction of the projection with the slider stop, the slider with the button, and the button with the lower sash effectively prevents further upward movement of the lower sash 500*b*.

Figure 5D:
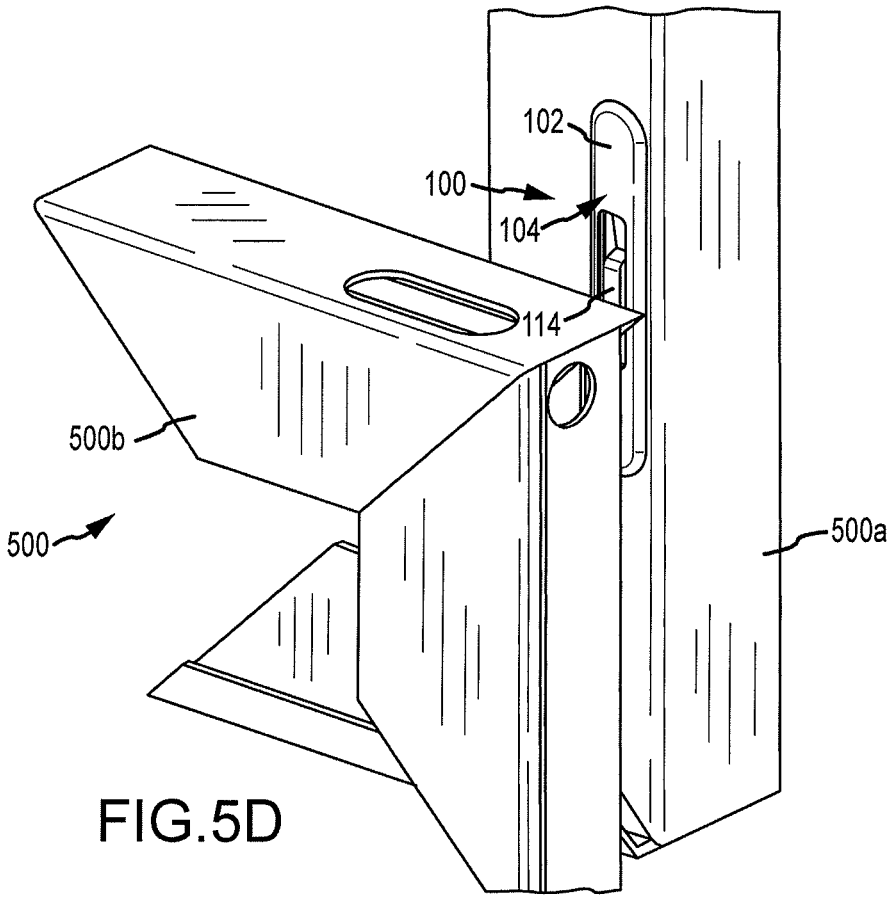
FIG. 5D is a partial front perspective view of the window of FIG. 5A having the window sash in an open range.

FIG. 5D depicts the lower sash 500*b* in an open range. In this case, the open range is any position in which an upper surface of the lower sash 500*b* has moved higher than the lower surface of the WOLD button 114. To move the lower sash 500*b* beyond the limited position, a user presses the button 114 into a retracted position within the WOLD 100, generally behind the bezel face 104. Once in the retracted position, due to gravity or the force of the return spring, the slider returns to its first bottom position and the button 114 is no longer positioned to prevent movement of the lower sash 500*b*, allowing the sash to be moved higher. As the lower sash 500*b* is returned to the closed range, the lower sash 500*b* again passes the button 114, and the spring forces the button 114 back into a projected position. This projected position will again prevent the window sash 500*b* from being completely opened without first disengaging the button 114.

Figure 6A:
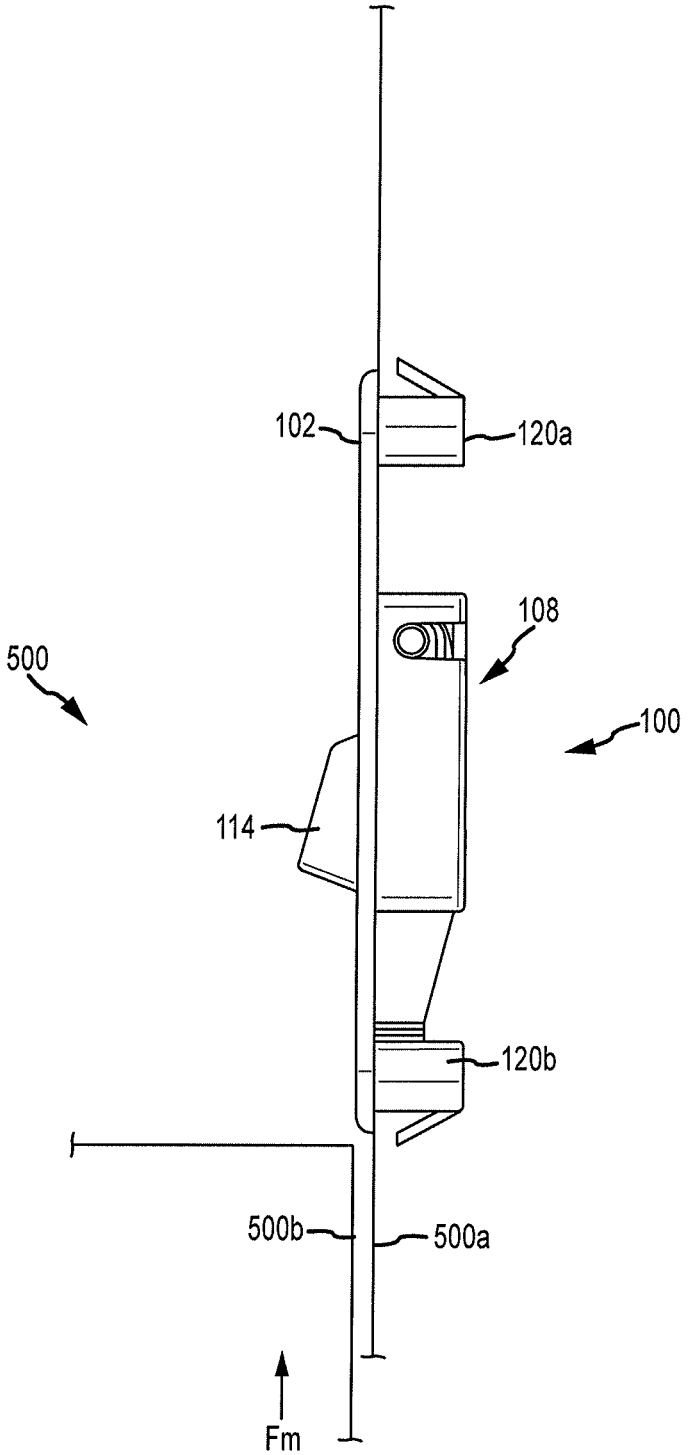
FIG. 6A is a partial side section view of the window sash of FIG. 6A in the closed range.
Figure 6B:
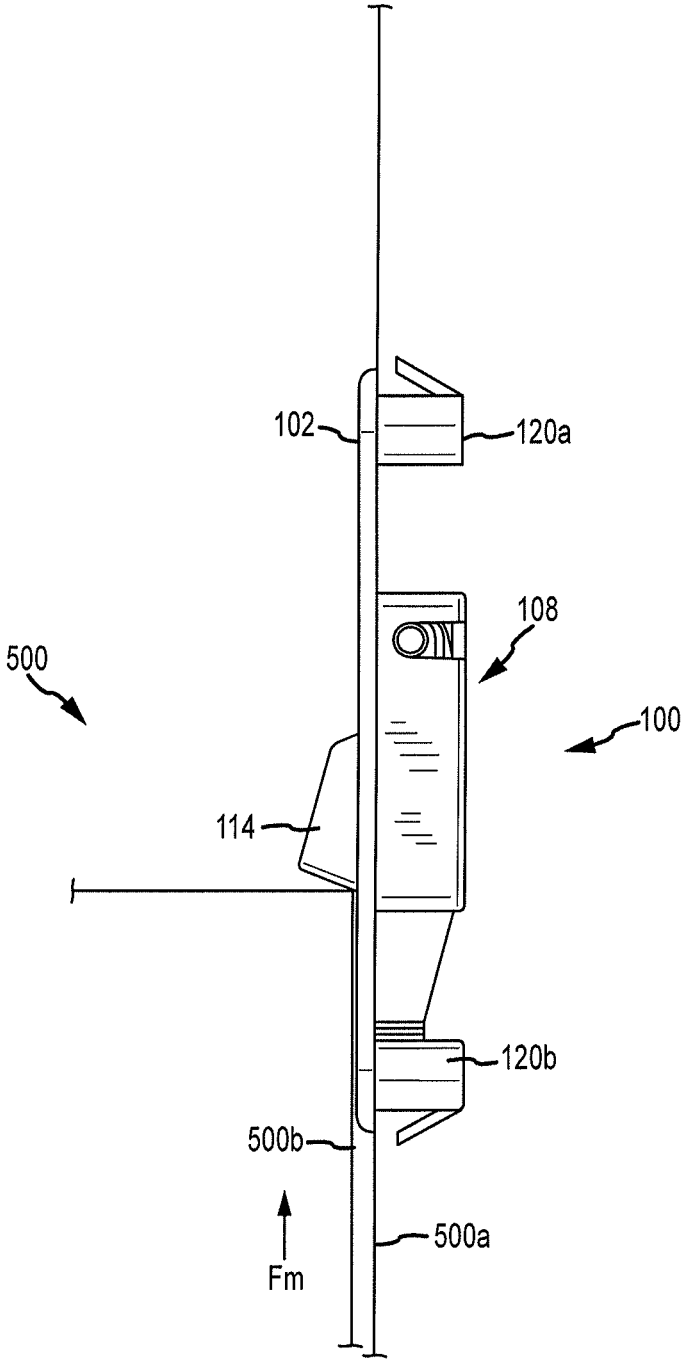
FIG. 6B is a partial side section view of the window sash of FIG. 6A in the contacted position.
Figure 6C:
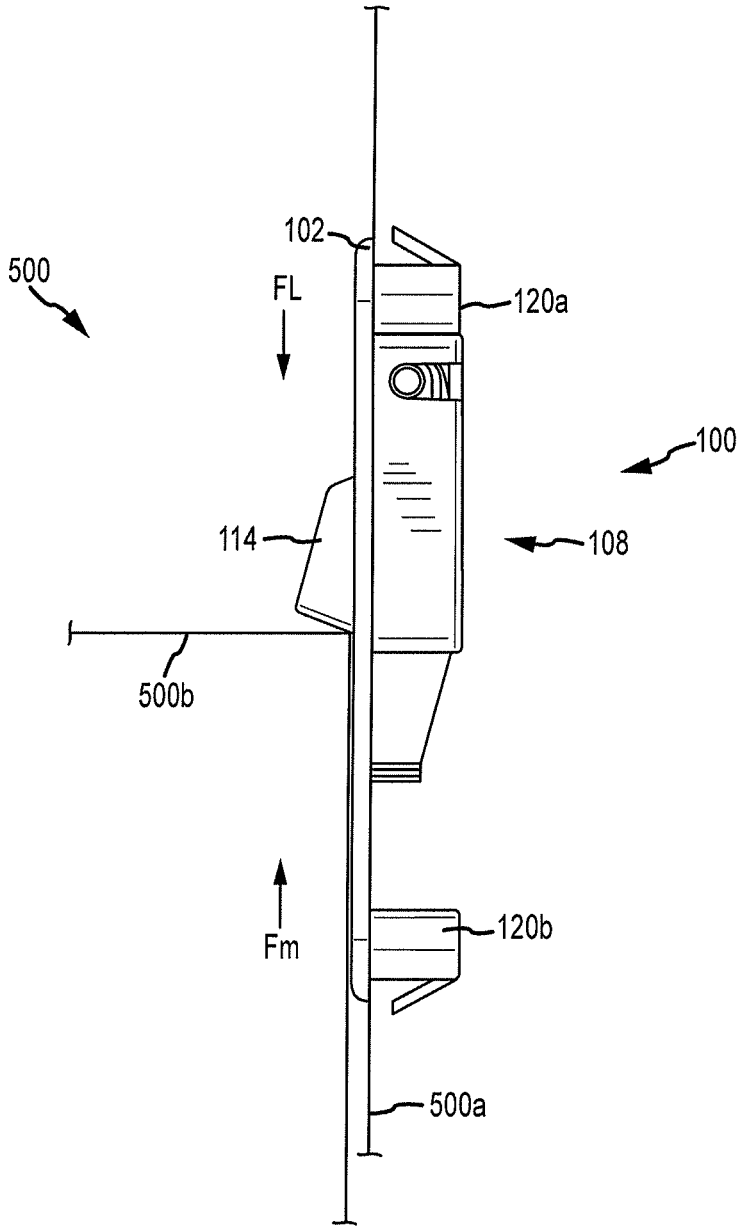
FIG. 6C is a partial side section view of the window sash of FIG. 6A in the limited position.

FIG. 6A is a partial side section view of the window 500 of FIG. 5A in the closed range. With the lower sash 500*b* in this range, the slider 108 is in a first or bottom position and the button 114 is biased into the projected position. Since the lower sash 500*b* is subject to a moving force $F_M$, typically by a person lifting the lower sash 500*b*, the lower sash 500*b* moves relative to the window frame and the upper sash 500*a*. As the moving force $F_M$ lifts the lower sash 500*b* higher, the lower sash 500*b* approaches the projected button 114. FIG. 6B is a partial side section view of the lower sash 500*b* in the contacted position, at the bottom of the contacted range. In the contacted range, the button 114 is in the projected position and contacts a portion of the lower sash 500*b*. As the moving force $F_M$ lifts the lower sash 500*b* higher, the interaction of the lower sash 500*b*, button 114, and slider 108 lifts the button 114 and slider 108 along with the lower sash 500*b*, through the entire contacted range. From the first slider position, where the slider 108 rests on the lower projection 120*b*, the slider 108 moves upward based on the moving force $F_M$, until it contacts the upper projection 120*a*, as depicted in FIG. 6C. In FIG. 6C, the lower sash 500*b* is in the limited position. In the limited position, the slider 108 interacts with the upper projection 120*a*, imposing a limiting force $F_L$ on further upward movement of the lower sash 500*b*, as long as the button 114 remains in the projected position, as depicted.

Figure 6D:
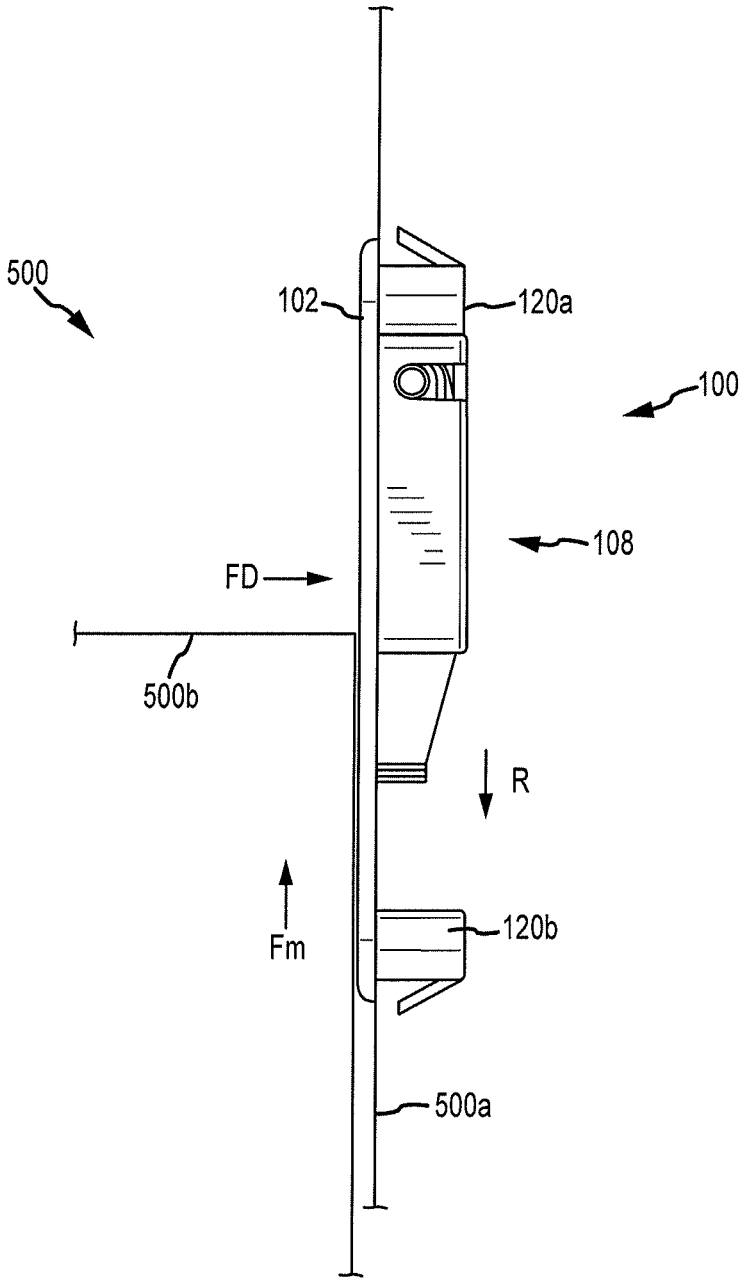
FIGS. 6D-6E are partial side section views of the window sash of FIG. 6A in the open range.
Figure 6E:
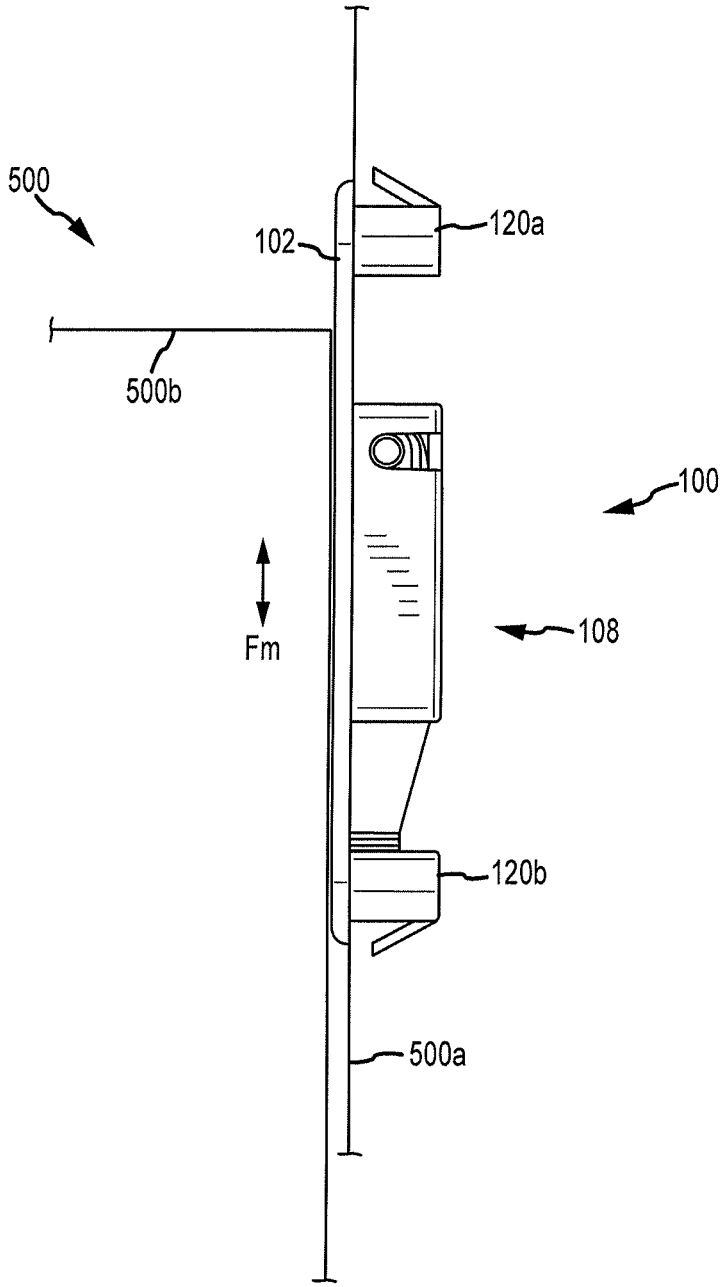

FIG. 6D depicts the lower sash 500*b* in the open range, after a disengaging force $F_D$ is directed toward the button 114, thereby moving the button 114 behind the bezel 102. As the button 114 is disengaged with the lower sash 500*b* and moved to the retracted position, the slider 108 returns from the second slider position (in contact with the upper projection 120*a*) to the first slider position (in contact with the lower projection 120*b*). This return R may be caused by gravity (in a vertical window application), return spring force, or a combination thereof. FIG. 6E depicts the lower sash 500*a* in an open range with the slider 108 returned to the first slider position, in contact with the lower projection 120*b*. With the button 114 remaining in the retracted position, due to the interaction with the lower sash 500*b*, the lower sash 500*b* is free to move up or down $F_M$, provided the top of the lower sash 500*b* does not move below the level of the button 114.

Figure 7A:
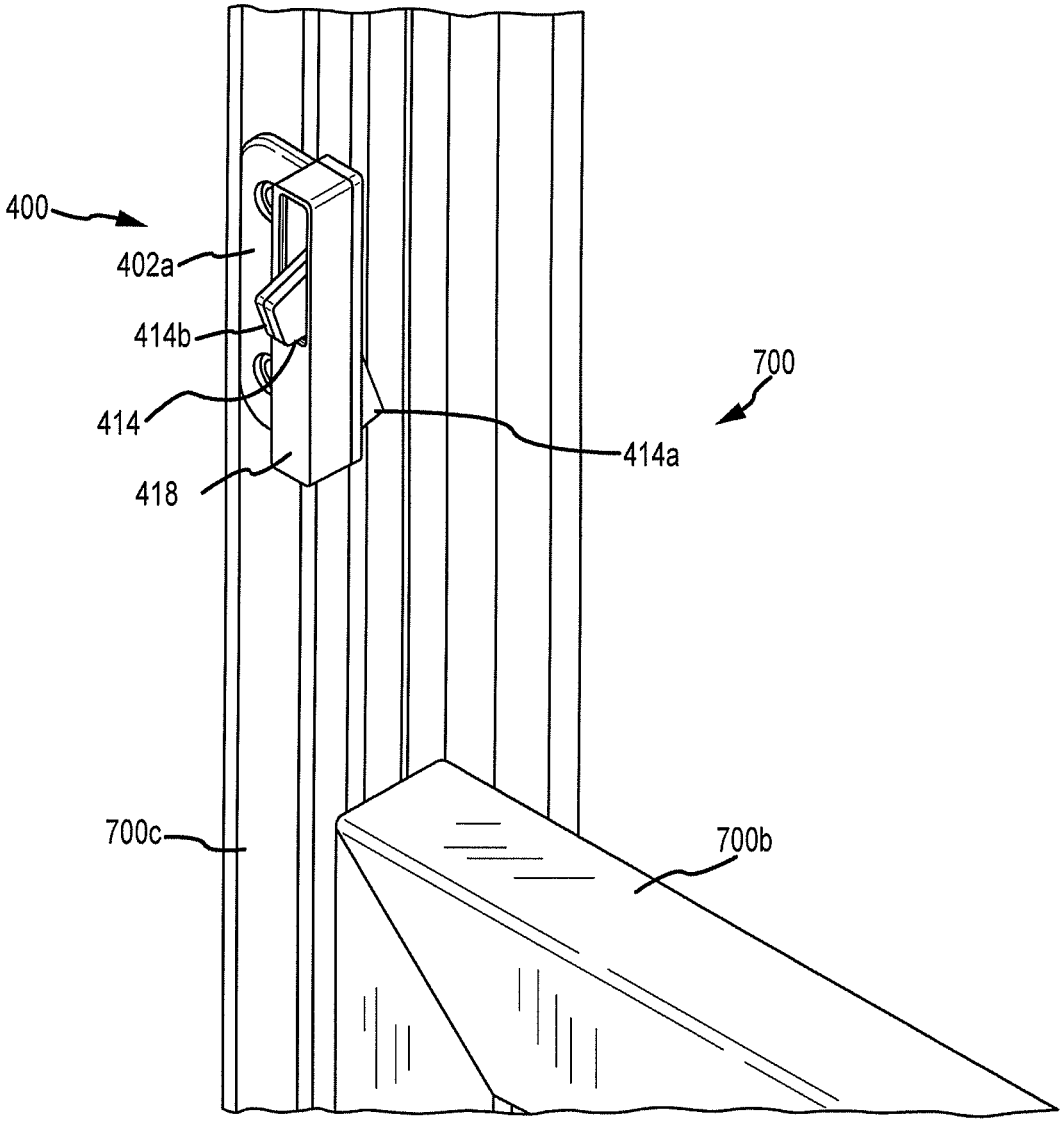
FIG. 7A is a partial front perspective view of a window having a window sash in a closed range.
Figure 7B:
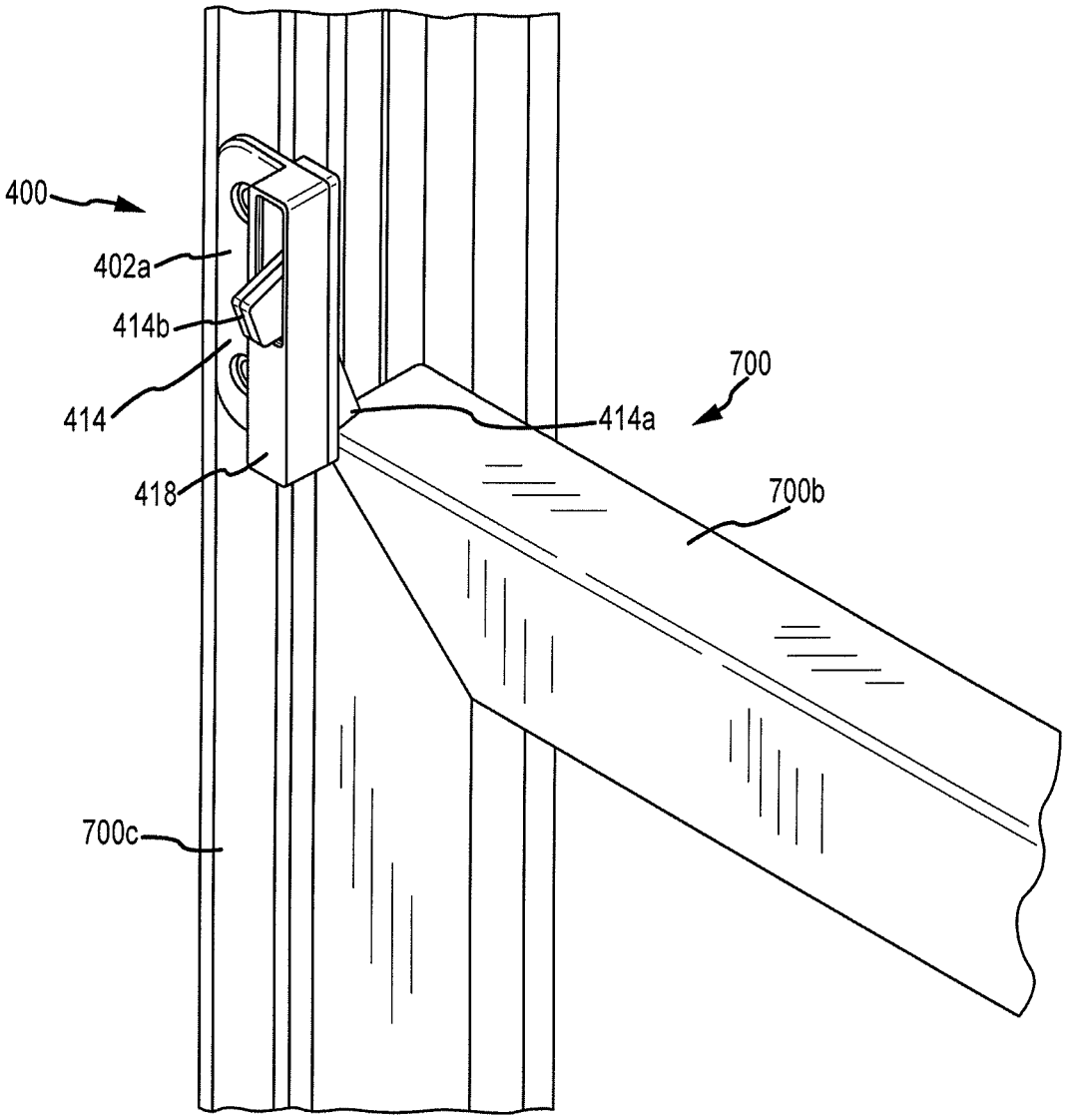
FIG. 7B is a partial front perspective view of the window of FIG. 7A in a contacted position.
Figure 7C:
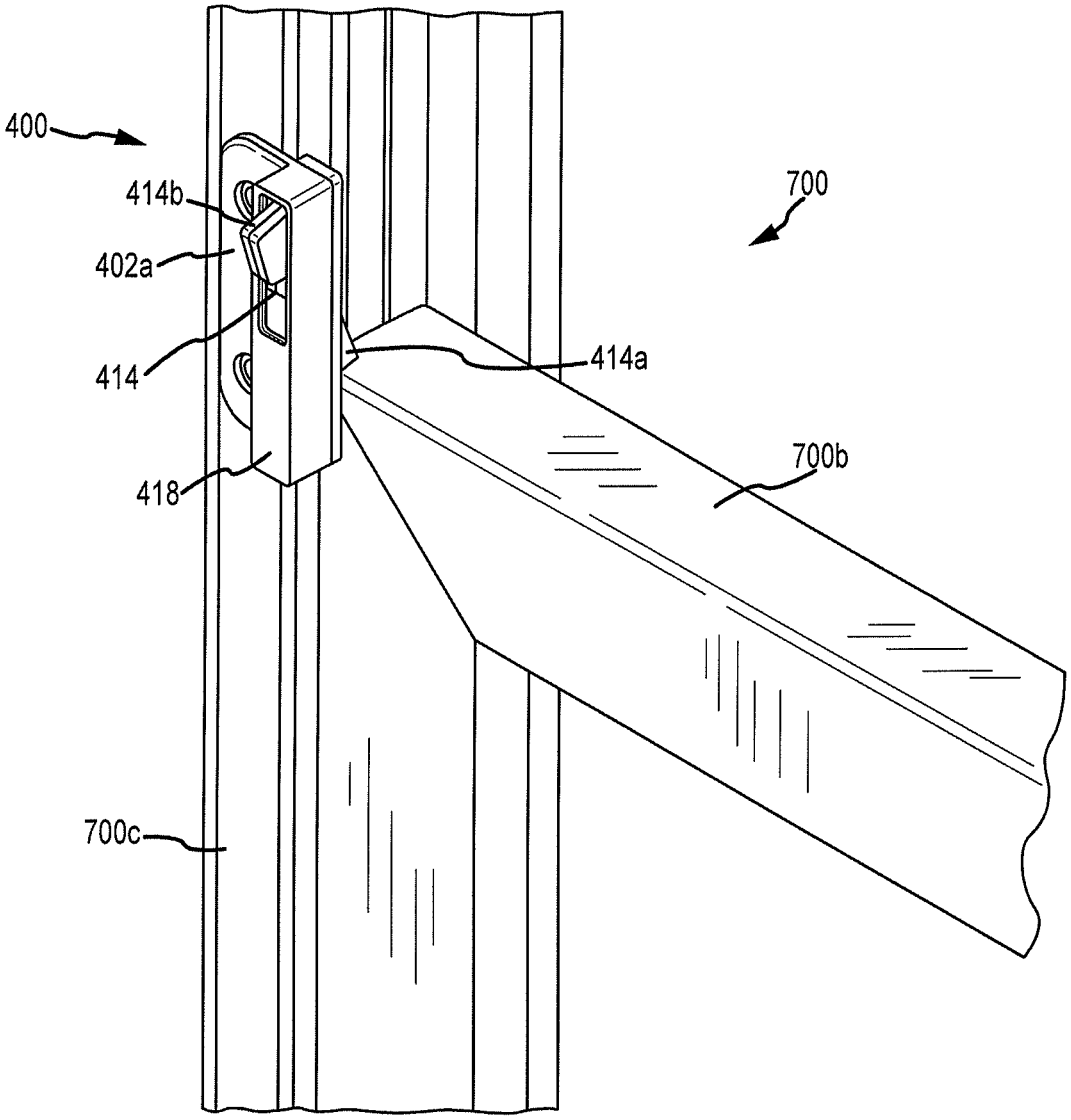
FIG. 7C is a partial front perspective view of the window of FIG. 7A in a limited position.

FIGS. 7A-7E depict the WOLD 400 of FIGS. 4A and 4B, mounted to a window frame 700*c*. This installation would be desirable for single hung windows, where only a single sash is movable. The WOLD 400 is secured to a window frame 400*c* via a flange 402*a* and one or more fasteners. Due to the location of the housing 418, the locking end 414*a* of the button 414 extends into a path of travel of the sash 700*b*. In FIG. 7A, which depicts the sash 700*b* in a closed range, both the locking end 414*a* and release end 414*b* of the button 414 are in a projected position, while the button 414 is in a first, bottom position. In the closed range, the sash 700*b* is not in contact with the locking end 414*a* of the button 414. FIG. 7B depicts the window sash 700*b* in the contacted position, where the locking end 414*a* of button 414 is in contact with a top surface of the sash 700*b*. FIG. 7C depicts the window sash 700*b* in the limited position, where the locking end 414*a* is in contact with the upper surface of the sash 700*b*. In the limited position, the button 414 is in a second, top position, thus preventing further upward movement of the window sash 700*b*.

Figure 7D:
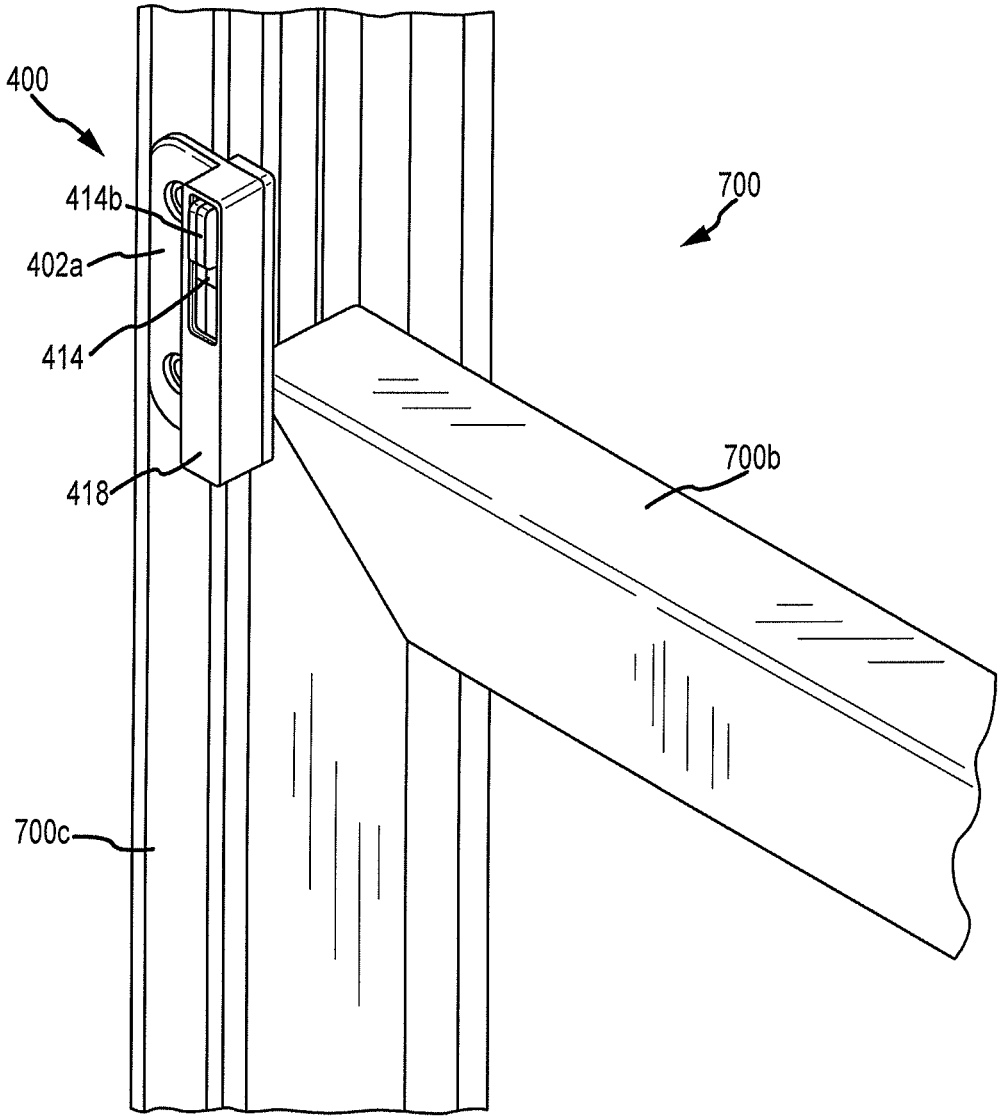
FIGS. 7D-7E are partial front perspective views of the window of FIG. 7A in an open range.
Figure 7E:
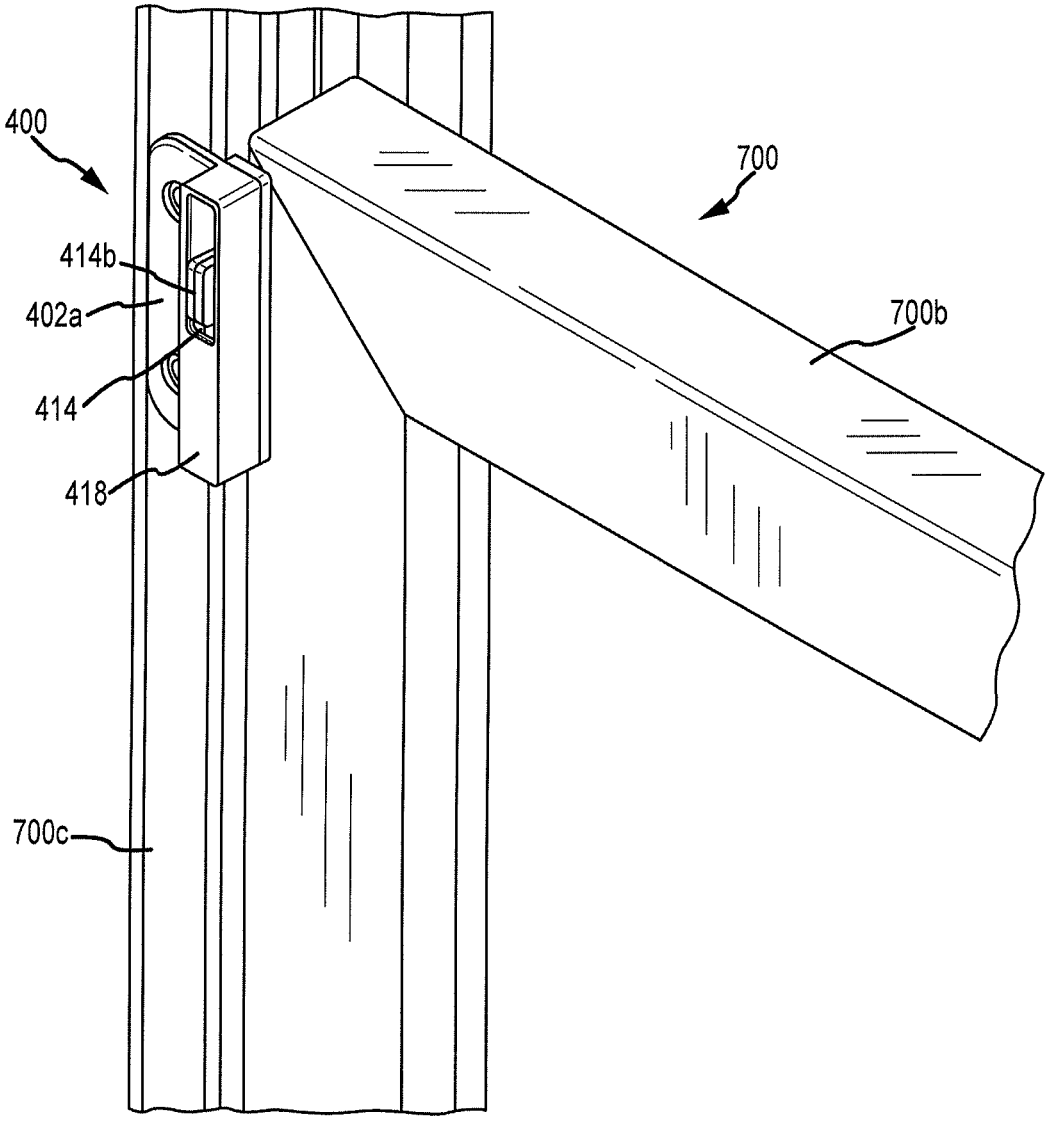

FIG. 7D depicts the window sash 700*b* in the open range, just after a force has been applied to the release end 414*b* of the button 414. The applied force pivots the button 414 about the projections, such that both the release end 414*b* and the locking end 414*a* are moved into retracted positions within the housing 418. In the open range, the locking end 414*a* is not in contact with the sash 700*b*. FIG. 7E depicts the window sash 700*b* in the open range, after the button 414 has returned to the first position due to the force of the spring within the housing 418. Thereafter, if the upper surface of the window sash 700*b* is moved below the level of the WOLD 400, the locking end 414*a* will automatically project into the path of travel of the sash 700*b*.

Figure 8A:
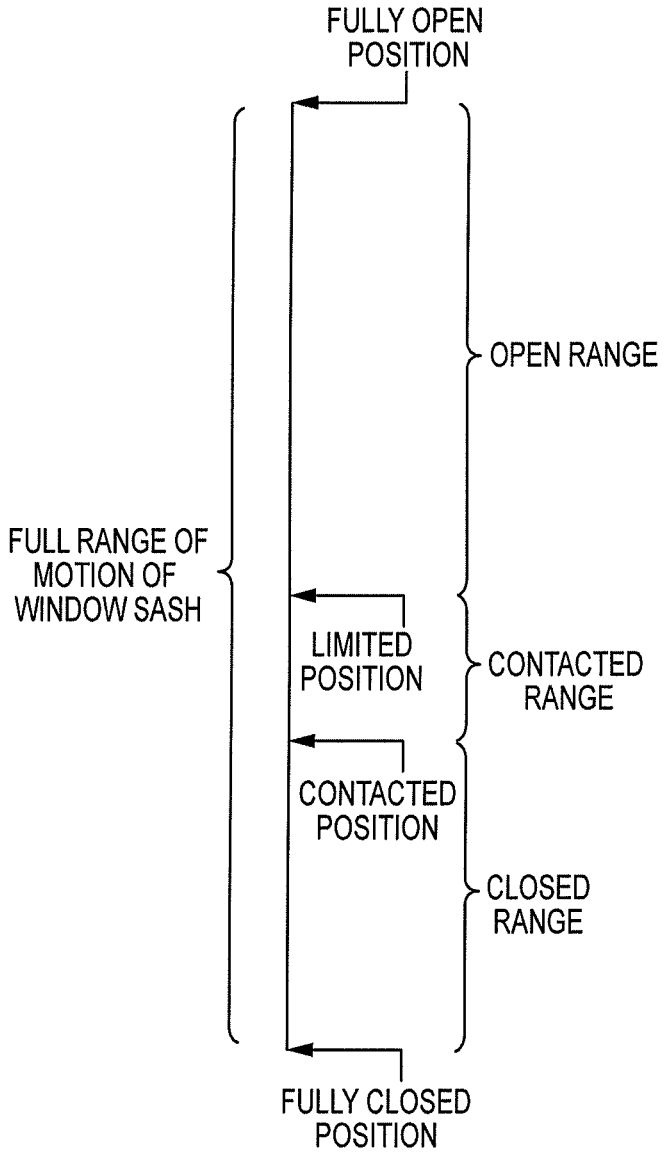
FIG. 8A depicts a schematic side view of the range of motion of a window sash having a window opening limit device.
Figure 8B:
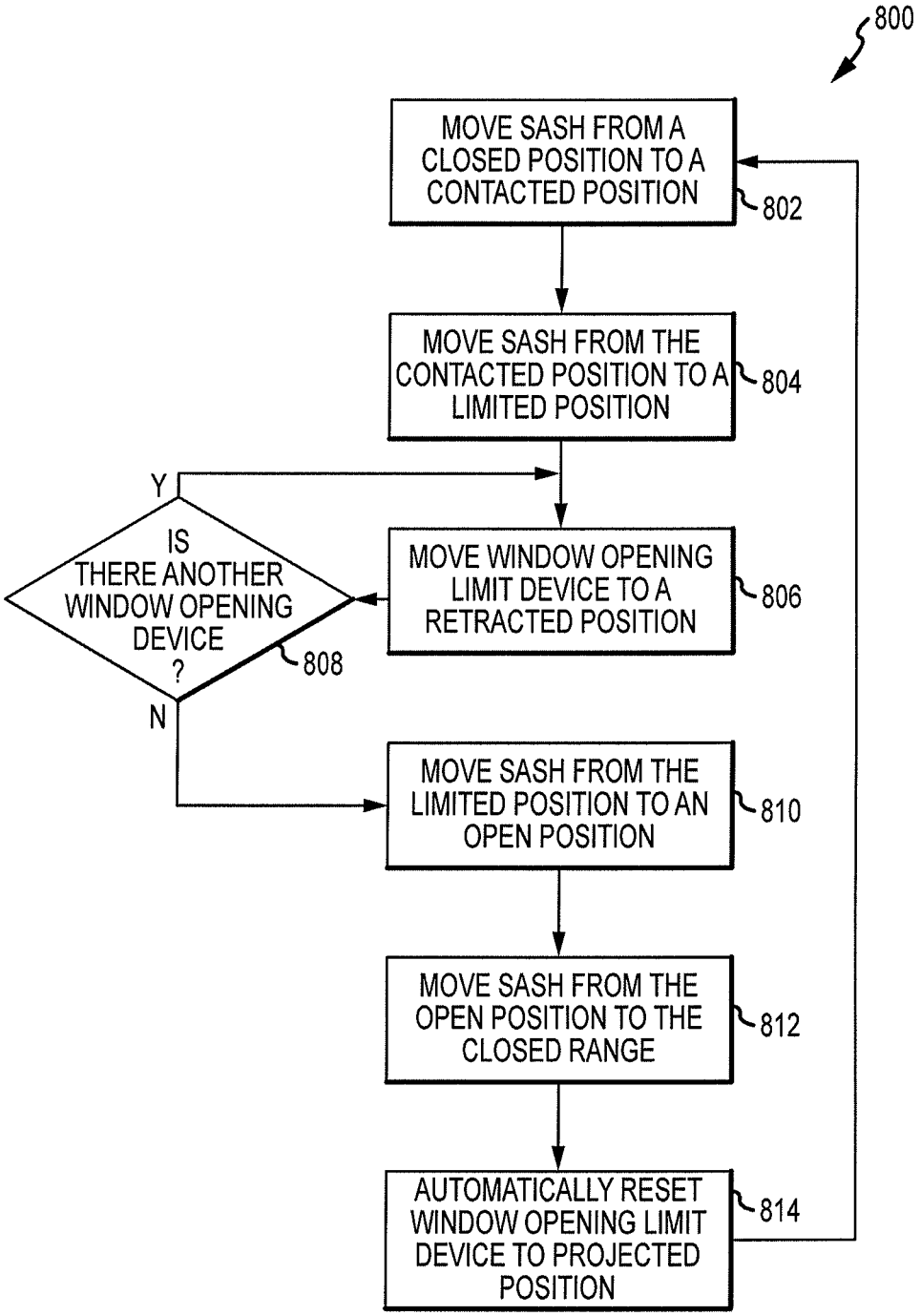
FIG. 8B depicts a method of opening a window having a window opening limit device.

FIG. 8A depicts a schematic side view of the range of motion of a window having a WOLD as described therein. The various positions and ranges are depicted in FIG. 8A and are referenced in the method depicted in FIG. 8B, below. FIG. 8B depicts a method of opening a window 800 that includes one or more WOLDs in accordance with one embodiment of the present technology. The first step of the method includes moving the window sash from a closed position to a contacted position 802 (that is, through the closed range, as described above). Thereafter, the sash is moved from the contacted position, through a contacted range, to a limited position 804. At this limited position, further movement of the sash is effectively impossible, due to projection of the button into the patch of travel of the sash. To enable additional movement of the sash, the WOLD is retracted 806. If more than one WOLD is present on the window 808 (in general, matching WOLDs on either side of a sash or frame are utilized), that WOLD is also moved to a retracted position 806. Thereafter, the sash may be moved from the limited position to an open range 810. The sash may then move freely anywhere in the open range, up or down. The sash may then be moved from the open position to the closed range 812. When moving the sash past the level of the button (which defines the top of the closed range), the button will automatically reset the button to the projected position 814. At that point, the WOLD is reset, such that another attempt to open the window past the limited position effectively will not be possible.

It is contemplated that more than one WOLD may be used on a window, typically one on each side of the sash. However, a single WOLD may be utilized if desired. Additionally, multiple WOLDs may be used on a single side of a window sash, to provide multiple limited positions, as desired for a particular application. Additionally, WOLDs may be installed on both the sash and the frame, for multiple limited positions, for additional security, or for both. The entire WOLD or components thereof may be manufactured by known techniques using injection molded plastics, including PVC, ABS, various grade densities of polyethylene, or other plastics typically used in the fenestration industry. Additionally, the entire WOLD or components thereof may be manufactured of stainless steel, brass, zinc, or other metals. Components described herein, for example, the bezel and housing of the embodiment of FIGS. 2A-2C, or the frame and flange of the embodiment of FIGS. 4A-4B, may be integrally or discretely manufactured.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A window opening limit device comprising:

a bezel comprising a bezel face and an opposite rear face;

a slider slidably engaged with the rear face of the bezel;

an opening defined within the bezel;

a button movably engaged with the slider, wherein the slider and the button are together slidable between a first position and a second position along the bezel, and wherein the button is pivotally positionable in a retracted positioned with the button disposed within the slider and a projected position with at least a portion of the button projecting from the slider and extending through the opening; and a biasing element that pivotally biases the button towards the projected position.

2. The window opening limit device of claim 1, wherein the button is connected to the slider with an axle.

3. The window opening limit device of claim 2, wherein the axle is disposed on an opposite end of the button from the biasing element.

4. The window opening limit device of claim 1, wherein the slider comprises an at least partially enclosed housing that houses the button.

5. The window opening limit device of claim 1, wherein the rear face of the bezel comprises a recess and the slider comprises a face, and wherein the recess is sized and shaped to at least partially receive the face and form a sliding track for the slider to engage with the bezel.

6. The window opening limit device of claim 1, wherein the bezel comprises at least one projection extending from the rear face of the bezel.

7. The window opening limit device of claim 6, wherein the slider includes at least one stop, and wherein when the at least one stop engages with the at least one projection, the slider is positioned at the first position or the second position along the bezel.

8. The window opening limit device of claim 6, wherein the slider comprises a housing that supports the button, and wherein the at least one stop is formed by a portion of the housing.

9. The window opening limit device of claim 6, wherein the slider comprises a housing that supports the button, and wherein the at least one stop is an extension element extending from the housing.

10. The window opening limit device of claim 1, further comprising a return spring for biasing the slider toward the first portion.

11. The window opening limit device of claim 1, wherein when the button is in the retracted position, the button is positioned substantially behind a plane defined by the bezel face, and wherein when the button is in the projected position, at least a portion of the button projects beyond the plane defined by the bezel face.

12. The window opening limit device of claim 1, further comprising at least one locking element for securing the window opening limit device to a window sash.

13. A window system comprising:

a first sash;

a second sash, wherein the first sash is slidable relative to the second sash; and a window opening limit device coupled to the second sash, wherein the window opening limit device comprises:

a bezel;

a slider slidably engaged with the bezel;

a button pivotably engaged with the slider, wherein the slider and the button are together slidable between a first position and a second position along the bezel, and wherein the button is positionable in a retracted position disposed within the slider and a projected position projecting from the slider; and a biasing element for biasing the button pivotably toward the projected position.

14. The window system of claim 13, wherein the first sash is slidably positionable in a closed range, a contacted range, a limited position, and an open range.

15. The window system of claim 14, wherein when the first sash is in the closed range, the button is in the projected position and the first sash is not engaged with the button.

16. The window system of claim 14, wherein when the first sash is in the contacted range, the button is in the projected position and the first sash is engaged with the button.

17. The window system of claim 14, wherein when the first sash is in the limited position, the button is in the projected position and the first sash is engaged with the button.

18. The window system of claim 14, wherein when the first sash is in the open range, the button is in the retracted position and the first sash is not engaged with the button.

19. The window system of claim 14, wherein the slider is in the first position when the first sash is in each of the closed range and the open range, and wherein the slider is in the second position when the first sash is in the limited position.

* * * * *